United States Patent [19]

Chiang et al.

[11] Patent Number: 4,738,610

[45] Date of Patent: Apr. 19, 1988

[54] ISOSTATIC PRESS USING A SHAPE MEMORY ALLOY

[75] Inventors: Tien-Hon Chiang, El Toro; Donald N. Thatcher, Brea, both of Calif.

[73] Assignee: Aerojet-General Corporation, La Jolla, Calif.

[21] Appl. No.: 938,204

[22] Filed: Dec. 4, 1986

[51] Int. Cl.[4] ..... B30B 12/00

[52] U.S. Cl. ..... 425/405.2; 148/402; 419/68; 425/78

[58] Field of Search ..... 148/402; 428/960; 419/49, 68; 425/77, 78, 405 R, 405 H, 407; 264/56

[56] References Cited

U.S. PATENT DOCUMENTS

| | | | |
|---|---|---|---|
| 3,353,954 | 11/1967 | Williams | 419/10 |
| 4,113,846 | 9/1978 | Sigurdsson | 425/77 |
| 4,225,300 | 9/1980 | Latter | 425/77 |
| 4,237,609 | 12/1980 | Clabburn et al. | 428/960 |
| 4,384,222 | 5/1983 | Zerlik | 285/48 |
| 4,481,180 | 11/1984 | Bedére et al. | 425/77 |
| 4,556,424 | 12/1985 | Viswanadham | 419/14 |
| 4,594,219 | 6/1986 | Hostatter et al. | 419/49 |
| 4,654,092 | 3/1987 | Melton | 148/402 |

FOREIGN PATENT DOCUMENTS

| | | | |
|---|---|---|---|
| 2705880 | 3/1978 | Fed. Rep. of Germany | 425/77 |
| 46-4035 | 3/1967 | Japan | 425/405 H |

OTHER PUBLICATIONS

"55-Nitinol—The Alloy with a Memory", A Report, NASA-SP5110, Jackson, C. M. et al., 1972, pp. 77-79.

*Primary Examiner*—Jay H. Woo
*Assistant Examiner*—J. Fortenberry
*Attorney, Agent, or Firm*—Leonard Tachner

[57] ABSTRACT

An apparatus using a shape memory alloy such as nickel-titanium as a die material for performing pseudo-isostatic pressing by using a uniaxial mechanical press to densify a powder mixture, preform or presinter with or without the use of pressure transmitting powder. The process can also be used to perform thermal mechanical work on any article to obtain near net shape. With controlled thermal mechanical processing and fabrication of the shape memory alloy into a die configuration, its shape can be changed from a low temperature configuration to a high temperature configuration after being heated. The shape transformation temperature for nickel-titanium alloy in particular, ranges from about −200 degrees Centigrade to +100 degrees Centigrade depending primarily upon alloy composition. For a hollowed cylindrical die made from nickel-titanium alloy which possesses shape memory effect, the inner diameter of the die can change as much as 8% and exert tens of thousands of pounds per square inch pressure in the radial direction. As a result, near net shape parts can be cold or hot pressed pseudo-isostatically without using an expensive and sophisticated press apparatus of the prior art.

10 Claims, 2 Drawing Sheets

ISOSTATIC PRESS USING A SHAPE MEMORY ALLOY

BACKGROUND OF THE INVENTION

1. Field of the Invention

The present invention relates generally to the field of mechanical processing of materials such as isostatically pressing materials and more specifically, to an apparatus and method for pressing parts by exploiting the anthropomorphic qualities of shape memory alloys.

2. Prior Art

The material that has come to be called shape memory alloys has been known for some time. By way of example, in an article entitled "Shape Memory Alloys" written by L. MacDonald Schetky and appearing in the Scientific American, November 1979 issue beginning at page 74, the author thoroughly explains the mechanical properties of these alloys and indicates that they first came to worldwide attention in 1962. As the author in that article explains, the phenomenon of shape memory alloys is dependent upon the characteristic of certain materials to possess a martensite crystal structure deriving from a parent crystal phase when treated by a certain combination of stress and temperature processing. This martensitic crystal phase can then be transformed back into its parent crystal phase thermoelastically by elevating the temperature of the material. In addition, for the "two-way" shape memory alloys, the phase transformation can be reversed by then lowering the temperature of the material. As a result of these phase transformations the material can be induced to change its shape in a carefully controlled and reversible manner by simply controlling the temperature of the material to induce the aforementioned phase transformations. The article by Schetky illustrates a particular exploitation of this phenomenon for automatically deploying an antenna for a spacecraft. An updated description of the "Shape Memory Effect Alloys" can also be found in the Encyclopedia of Materials Science and Engineering", volume 6, pages 4365–4374, M.I.T. Press, 1986. However, it is believed that the use of this phenomenon in a press or die for applying reasonably high mechanical pressure forces for pseudo-isostatically pressing one or more parts is a unique application of this phenomenon which has heretofore not been disclosed in the art. The most relevant prior art known to the applicants in this regard will now be disclosed.

U.S. Pat. No. 3,558,369 to Wang et al is directed to a method of effecting a reversion back to an original configuration by means of a martensitic transition of a metal alloy. The alloy is subjected when in an original configuration to deformation at a temperature below a critical temperature to change the shape and then heat the alloy above the critical temperature to effect a reversion.

U.S. Pat. No. 3,579,805 to Kast is directed to a method of forming interference fits by heat treatment. In this patent, members are provided which are formed of a precipitation hardenable alloy composition which undergoes irreversible dimensional changes upon heat treatment. The precipitation hardenable alloy is solution annealed at a temperature higher than the solutioning temperature of the alloy. The members are interfit to form an assembly with a clearance between the members which is less than the irreversible dimensional change and the assembly is subjected to a precipitation hardening heat treatment which causes the irreversible dimensional change.

U.S. Pat. No. 3,832,763 to Schober is directed to a method of drop-forging sintered workpieces. This disclosure provides essentially for a deviation of the shape of the drop forging die wherein a solid cylindrical prestressed body is placed into the cavity of a forging die. The cavity of the forging die has a lateral dimension normal to the forging direction wherein this lateral dimension is larger than the diameter of the body. There is no reference to a shape memory alloy die.

U.S. Pat. No. 4,019,925 to Nenno et al is directed to metal articles having a property of repeatedly reversible shape memory effect and the process for preparing such which includes deformation stress to a martensitic alloy.

U.S. Pat. No. 4,036,669 to Brook et al is directed to a mechanical pre-conditioning method and to a mechanical composition capable of undergoing a reversible transformation between the austenitic and martensitic states. The article is deformed from an original configuration into a second predetermined shape from which heat recovery towards the original configuration is desired. Constraining forces are applied to the article and the article is held in the deformed configuration at a predetermined high temperature at which the formation of the martensite in the metallic composition is induced thermally in the absence of applied stress for a predetermined time. This causes a portion of the deformation to be retained as heat recoverable strain.

U.S. Pat. No. 4,149,911 to Clabburn is directed to a memory metal article and a method of making the heat recoverable memory metal number. A stess is applied to the member in a deformed dimensionally heat-unstable state and such temporarily increases the temperature at which formation of austenite begins. This is accomplished while maintaining an applied stress. The article is stored at a temperature less than the higher temperature and the memory metal member than remains in a martensitic state.

U.S. Pat. No. 4,198,081 to Harrison et al is directed to a heat recoverable metallic coupling. A coupling is installed on pipes to be connected and the joint is heated to greater than the transition temperature of the material of the coupling.

The coupling is heat recoverable and recovers or shrinks to the heat-stable configuration until it engages the objects and is restrained from further recovery. This creates a tight fit on the object as long as the joint is maintained above the transition temperature. The restraining action of the objects on the coupling introduces non-thermally recoverable plastic deformation stresses into the material of the coupling and when the coupling is cooled to the transition temperature, the stresses are released in spontaneous expansion and the coupling may be removed from the objects.

U.S. Pat. No. 4,283,233 to Goldstein et al is directed to a method of modifying the transition temperature range of a nickel-titanium based shape memory alloys. This is done by the selection of the final annealing temperature. The alloy however is formed into a predetermined permanent shape.

U.S. Pat. No. 4,533,411 to Melton is directed to a method of processing nickel-titanium base shape-memory alloys and structures. The reference teaches cold working an alloy formed of a nickel-titanium based shape memory alloy and provides the alloy in some desired shape while maintaining dislocation-free cells which are obtained in the annealing step. The alloy is deformed in the martensitic state whereby when the alloy is recovered by heating the alloy to the austenitic state and then again cooled to the martensitic state, the alloy will retain the predetermined contour.

Other prior art patents which may be deemed to be relevant to the present invention comprising the following:

| | | | |
|---|---|---|---|
| 3,285,470 | Frei et al | 4,310,354 | Fountain et al |
| 3,622,941 | Wetmore | 4,365,996 | Melton et al |
| 3,652,969 | Willson et al | 4,412,872 | Albrecht et al |
| 3,783,037 | Brook et al | 4,483,174 | Goodfellow |
| 4,035,007 | Harrison et al | 4,489,964 | Kipp et al |
| 4,045,644 | Shafer et al | 4,518,444 | Albrecht et al |
| 4,067,752 | Brook et al | 4,554,027 | Tautzenberger et al |
| 4,113,475 | Smith | | |

SUMMARY OF THE INVENTION

The present invention relates to an apparatus and process using a shape memory alloy such as nickel-titanium as a die material for performing pseudo-isostatic pressing by using a uniaxial mechanical press to densify a powder mixture, preform or presinter with or without the use of pressure transmitting powder. The process can also be used to perform thermal mechanical work on any article to obtain near net shape. With controlled thermal mechanical processing and fabrication of the shape memory alloy into a die configuration, its shape can be changed from a low temperature configuration to a high temperature configuration after being heated. The shape transformation temperature for nickel-titanium alloy in particular, ranges from about −200 degrees Centigrade to +100 degrees Centigrade depending primarily upon alloy composition. For a hollowed cylindrical die made from nickel-titanium alloy which possesses shape memory effect, the inner diameter of the die can change as much as 8% and exert tens of thousands of pounds per square inch pressure in the radial direction. As a result, near net shape parts can be cold or hot pressed pseudo-isostatically without using an expensive and sophisticated press apparatus of the prior art.

In one disclosed embodiment of the invention, a simple uniaxial vertical press is used as a component of the present invention. In the simplest form the process and apparatus of the present invention are used to densify a powder mixture such as a metal, ceramic or combination of the two by controlling the temperature of the shape memory alloy material of which the die is configured to create a phase transformation from martensitic to its parent phase to decrease the volume of the chamber within the die in which the part to be pressed is positioned.

Although in an embodiment of the invention described herein, the shape memory alloy die is provided in a cylindrical configuration and a uniaxial vertical press is utilized to complement the pressing apparatus and process, the invention is not deemed to be limited to any particular die configuration. In fact, it would be entirely plausible to provide the die in the shape of a sphere or other fully enclosed volumetric shape to accomplish the objectives of the invention. A pressure transmitting powder, commonly known in the materials processing art, may be used to fill the chamber when the parts to be pressed do not otherwise utilize the full volumetric capacity of the chamber, in order to apply substantially isostatic forces to the parts to be pressed. Temperature control of the shape memory alloy material may be accomplished in a variety of ways, however, one embodiment of such temperature control disclosed herein comprises the use of a coil-shaped tube comprising a thermally conductive material such as copper for carrying a cooling or heating fluid, the coil being in contiguous engagement with the outer periphery of the die. The present invention may be summarized as being an apparatus and process which provide a press or die comprising shape memory alloys having anthropomorphic qualities which significantly reduce the otherwise costly and complex requirements of conventional isostatic pressing devices.

OBJECTS OF THE INVENTION

It is therefore a principal object of the present invention to provide an apparatus and process for mechanically treating materials and specifically for pseudo-isostatically pressing materials by taking advantage of the controlled anthropomorphic qualities of shape memory alloys.

It is an additional object of the present invention to provide a pseudo-isostatic press at least a portion of which comprises a shape memory alloy defining an interior chamber into which parts to be pressed may be placed and which exerts a selected force upon such parts in response to temperature variation of the alloy material.

It is still an additional object of the present invention to provide a pseudo-isostatic pressing apparatus comprising a hollow enclosed structure at least a portion of which is formed of a shape memory alloy capable of reversible dimensional modification when selectively transformed from a martensitic phase to its parent phase by temperature elevation.

It is still a further object of the present invention to provide a method of pseudo-isostatically pressing parts, the method comprising the steps of placing the parts in a hollow enclosed structure at least a portion of which is formed of a shape memory alloy capable of a reversible dimensional modification when selectively transformed from a martensitic phase to its parent phase by temperature elevation, surrounding the parts with a pressure transmitting medium and then raising the temperature of the alloy for a predetermined period of time.

It is still an additional object of the present invention to provide a cylindrically shaped press or die comprising a shape memory alloy material, at least one open end of the cylinder being closed by a mechanical vertical press the action of which is synchronized to the elevation of the temperature of the alloy die whereby to create a highly pressurized chamber within which parts can be pseudo-isostatically pressed.

BRIEF DESCRIPTION OF THE DRAWINGS

The aforementioned objects and advantages of the present invention as well as additional objects and advantages thereof will be more fully understood hereinafter as a result of a detailed description of preferred embodiments of the invention when taken in conjunction with the following drawings in which.

DETAILED DESCRIPTION OF PREFERRED EMBODIMENTS

Figure 1:
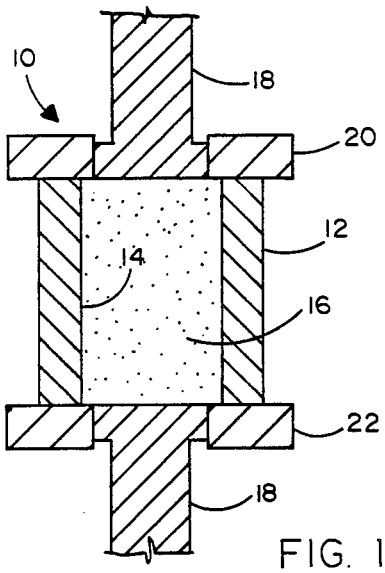
FIGS. 1 and 2 illustrate the inactive and activated configurations, respectively, of a first embodiment of the present invention.
Figure 2:
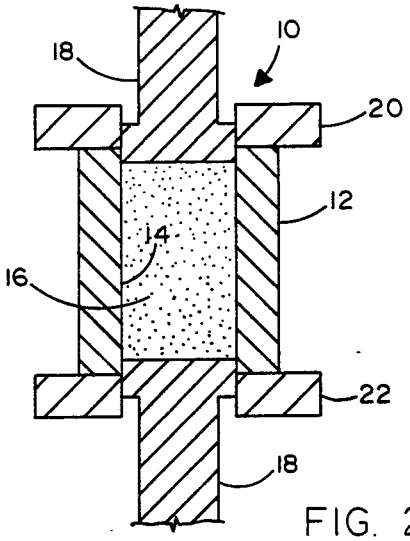

A first embodiment of the invention is illustrated in FIGS. 1 and 2. As shown in those figures, a pseudo-isostatic press 10 comprises a shape memory alloy die 12 in the form of a circular cylinder hollowed to form an interior chamber 14 into which either a pressure transmitting powder or powder mixture 16 to be pressed is inserted. In the particular embodiment illustrated in FIGS. 1 and 2 a pair of mechanical rams 18 is provided to seal the axial ends of the shape memory alloy die 12 and provide a means for exerting an axially directed force concurrently with the radially directed force induced by the die 12. An end cap 20 is provided at the top of cylinder 12 and a base 22 is provided at the bottom of cylinder 12. The end cap 20 and base 22 are each of annular configuration each having an inner diameter which is approximately equal to the inner diameter of the shape memory die 12 when the latter is in its high temperature parent phase state which is also equal to the diameter of the ram portion of mechanical rams 18. In this fashion the chamber 14 is always sealed by the combination of the die 12, the mechanical rams 18, the end cap 20 and the base 22 and the rams, the press, the end cap and the base are configured so that during the pressurization cycle the mechanical ram 18 is not jammed by the die 12.

The shape memory alloy comprising the die 12 may be any one of a plurality of alloys which exhibit the shape memory characteristic. The following alloys have exhibited such a characteristic: gold-cadmium, nickel-titanium, indium-thallium, indium-cadmium, iron-nickel, nickel-aluminum, copper-zinc, copper-aluminum, iron-platinum, silver-zinc, silver-cadmium, uranium-niobium, nickel-copper-titanium and copper-aluminum-zinc. Because of material characteristics and cost considerations of the previously mentioned group of shape memory effect alloys, the most likely candidates for use in the present invention are nickel-titanium, iron-nickel, nickel-copper-titanium and copper-aluminum-zinc.

To start a pressurization cycle for pressing either the powder 16 or an article contained within the chamber and surrounded by pressure transmitting powder, the shape memory alloy die is heated by using an external heating device, assuming the transformation temperature is above room temperature, to reach transformation temperature and trigger the martensitic to its parent phase transformation. When the die reaches transformation temperature it will change rapidly from its low temperature, martensitic to its high temperature, parent phase configuration as shown in the transition between FIGS. 1 and 2. As a result, the die exerts a preselected level of lateral pressure on the powder 16. In the meantime, the mechanical rams 18 maintain a proper level of pressure on the die cavity such that the effect of isostatic pressing is optimized. After the pressing cycle is completed the die assembly is cooled to a lower temperature so that the densified mixture 16 can be easily removed from the die cavity. The shape memory effect of the die is reversible with proper alloy selection and thermal mechanical processing. As a result, the high temperature configuration of the die may be returned to its low temperature configuration after being cooled and/or reprocessed and may be reused for subsequent pressing.

Figure 3:
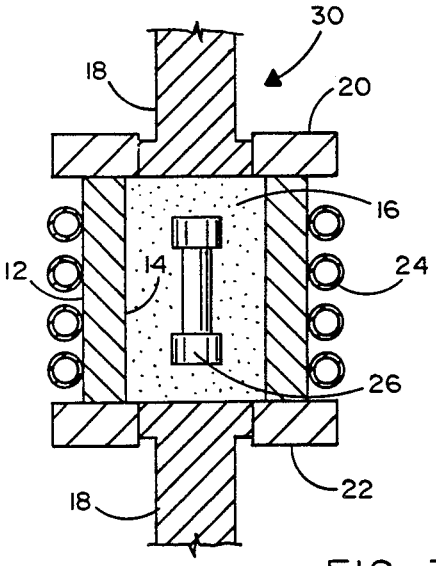
FIGS. 3 and 4 indicate the inactive and activated configurations, respectively, or a second embodiment of the present invention.
Figure 4:
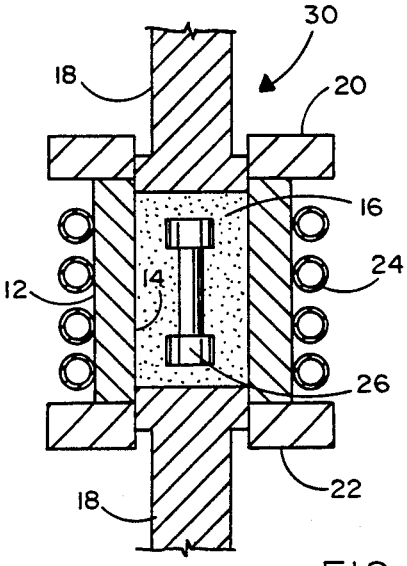

The process of the present invention can also be applied to hot or cold pressing any powder mixture preform, presinter or solid part into a more complicated shape with some minor modification of the basic process described above. The steps for pressing complicated shape articles is depicted in FIGS. 3 and 4 which illustrate an alternative embodiment of the present invention. As shown in FIGS. 3 and 4 the part or preform 26 to be pressed is placed into the chamber 14 of the shape memory die 12 of the second embodiment 30. If the part 26 does not fill up the die cavity or chamber 14, pressure transmitting powder 16 may be used to pack the die chamber. The particle size, shape and physiochemical nature of the pressure transmitting powder are carefully selected so that friction loss during pressurization is minimized. If the part 26 is to be hot pressed, the part is preheated to the desired temperature before the pressure transmitting powder 16 is added to the chamber. Alternatively, the pressure transmitting powder 16 may be heated which in turn heats the part 26. High temperature chemical stability of the pressure transmitting powder 16 is an important consideration for avoiding undesirable reaction among the part 26, the powder 16 and the die 12.

The temperature of the shape memory alloy die 12 may be controlled in a number of ways, however, in the particular embodiment illustrated in FIGS. 3 and 4 temperature control is provided by a tube 24 which is helically wound around the outer periphery of the die and is in contiguous engagement therewith. Coil 24 is preferably made of a thermally conductive material such as copper. The temperature of the coil may be controlled by the use of selected fluids for flowing therethrough depending upon the temperature requirements during the pressing process. Thus for example, during the packing of the part within the chamber 14, with or without pressure transmitting powder 16, the die may be retained in its low temperature configuration by circulating cooling water or other flowable coolant through the copper tube 24. The chamber 14 is packed so that the surface of the part 26 is subjected to an adequate level of compression during the pressurization cycle. This is particularly important when the pressure transmitting powder 16 is used. It may be desirable to use the mechanical press or rams 18, which may be of either a single or double action type, to prepress the filled die chamber before the shape memory alloy die is activated. As in the first embodiment of the invention illustrated in FIGS. 1 and 2, the die assembly is covered by an end cap 20 and is supported by a base 22. Here again, the mechanical rams 18, the end cap 20 and the base 22 are configured so that during the pressurization cycle the rams are not jammed by the die.

To begin a pressurization cycle for cold pressing, the shape memory alloy die is heated by using an external heating device to reach transformation temperature and trigger the martensitic to its parent phase transformation. For hot pressing a temperature control mechanism can be adapted so that the heated part 26 and/or the heated pressure transmitting powder 16 can heat up the die when needed to trigger the transformation. Alternatively, the coil 24 may be used to apply the phase transformation temperature to the die by substituting a hot flowable material for the cooling water previously mentioned.

When the die 12 reaches the transformation temperature its configuration changes rapidly from the low temperature to the high temperature state. The result is a reduction in the diameter of the chamber 14 as shown in FIG. 4 and the exertion of a desirable level of lateral pressure on the pressure transmitting powder 16 and/or the part 26. Concurrently, the mechanical rams 18 maintain a proper level of pressure on the die cavity so that the effect of isostatic pressing is optimized. After the pressing cycle is completed the die assembly is cooled to a lower temperature so that the densified part 26 can be easily removed from the die cavity. The shape memory effect of the die is reversible with proper alloy selection and thermal mechanical processing. As a result, the high temperature configuration may return to its low temperature state after being cooled and/or reprocessed and may be reused for subsequent pressing.

It will be understood that neither the particular configurations illustrated in FIGS. 1–4 nor the particular shape of the shape memory alloy die illustrated therein are to be deemed limiting of the present invention. Thus for example, other shapes for the shaped memory die of the present invention may be utilized as long as an enclosed chamber can be implemented. Spherically configured shape memory alloy presses, for example, may also be suitable for use in the present invention while obviating the requirement for a supplementary mechanical press for axially loading the contents of the chamber as discussed above. Alternatively, the cylindrical die configuration of FIGS. 1–4 may be other than circular in cross-section. Oval shapes or rectangular shapes may also be useable for carrying out the process of pressing utilizing the shape memory characteristic of the die material.

If a mechanical ram is desired or necessary as a result of the shape of the die, it is possible to carry out the process of the present invention using only one such mechanical ram on one axial end of the die and a fixed base on the other end.

Figure 5:
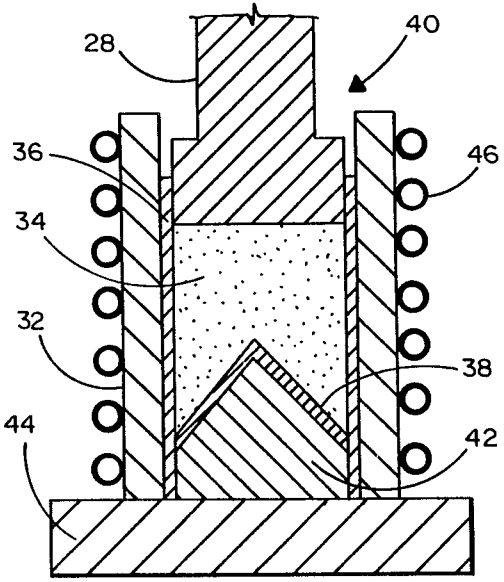

The process of the present invention finds particularly advantageous use in the fabrication of penetrator-type projectiles. By way of example, FIG. 5 illustrates the use of an alternative configuration of the invention for pressing the explosive on a shaped charge liners using shape memory alloy dies for better density distribution. In particular, in the alternative embodiment 40 illustrated in FIG. 5, the die assembly comprises a shape memory alloy cylinder 32 forming a chamber for containing a PBX explosive powder 34 within a case 36. The chamber also receives a shaped charge liner 38 which is formed on a mandrel 42 contained within the chamber. The bottom end of the chamber is enclosed by a base 44 of fixed configuration and the top end is secured by a mechanical plunger 28. A temperature control coil 46 provides the temperature variation required to activate the shape memory alloy in the manner previously described.

Figure 6:
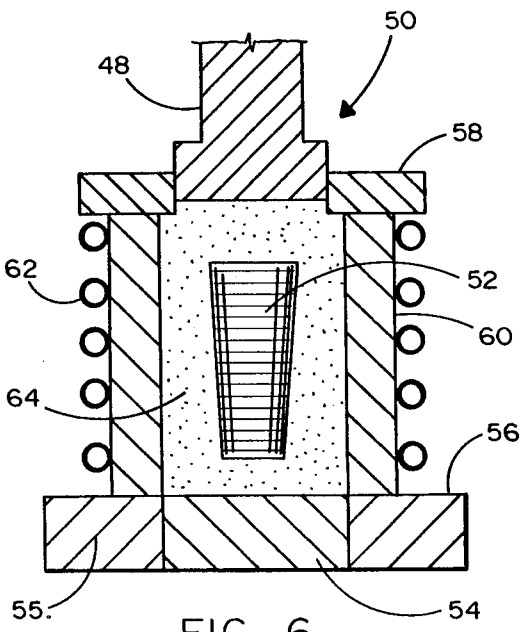
FIGS. 5 and 6 illustrate two additional embodiments of the invention for use on specific shapes of articles to be pressed in accordance with the process of the present invention.

In another alternative embodiment shown in FIG. 6, a pseudo-isostatic press 50 is used to fabricate a graded penetrator 52. The embodiment 50 comprises a shape memory alloy hollowed cylinder 60 surrounded by a temperature control coil 62 and forming a chamber filled with a pressure transmitting powder 64. A mechanical plunger 48 is used to secure the top-most axial end of the die assembly in conjunction with an end cap 58 while a double action ram 54 and base 55 provide means for enclosing the lower end of the chamber within the hollowed cylinder 60.

It will now be understood that what has been disclosed herein comprises a unique new pseudo-isostatic press and process for pressing employing a shape memory alloy in the form of a die, the die being configured to provide a chamber for receiving one or more parts to be pressed pseudo-isostatically. The chamber may also be adapted to receive a pressure transmitting powder for parts which do not otherwise fill the chamber. The die may be operated in conjunction with one or more vertical presses, rams or plungers if needed to seal the chamber and maintain the pressure during activation of the die. An end cap may be used to configure the interface between the die and the vertical press during the pressurization cycle so that the die does not jam the vertically moving member. Temperature control means such as a helically wound copper coil carrying a suitably cooled or heated fluid, may be used to control the temperature of the shape memory alloy to trigger a transformation between a martensitic phase and its parent phase in the alloy thereby reducing the inner diameter of the chamber and thus providing a substantial increase in pressure applied to the part. The method of the present invention, namely, the method of pseudo-isostatically pressing parts, comprises the steps of placing the parts in a hollow enclosed structure at least a portion of which is formed of a shape memory alloy capable of reversible dimensional modification when selectively transformed from a martensitic phase to its parent phase by temperature elevation, surrounding the parts with a pressure transmitting medium and then raising the temperature of the alloy for a predetermined period of time. As a result of the present invention the complex and costly structure of prior art isostatic presses may be significantly reduced.

Those having skill in the art to which the present invention pertains will now as a result of the teaching herein perceive various modifications and additions to the invention. By way of example, other shape memory alloy materials which also exhibit the anthropomorphic qualities of the specific materials recited herein may be substituted for those disclosed in the application. Furthermore, other geometric shapes of the alloy forming die for the purpose intended herein, will now occur as well as various alternative modifications which use different geometric configurations and different combinations of shape memory alloy dies and other mechanical pressure-inducing devices for subjecting the parts within the chamber to the requisite isostatic pressure levels. However, it will be understood that all such modifications and additions are deemed to be within the scope of the invention which is to be limited only by the claims appended hereto.

We claim:

1. A isostatic press comprising:

a hollow cylinder the wall of which comprises a shape memory alloy, the cylinder forming an interior chamber for receiving parts to be pressed, the axial ends of said chamber being enclosed;

at least one mechanical ram enclosing an axial end of said chamber for applying axially-directed pressure on said parts;

means controlling the temperature of said shape memory alloy for selectively causing transformation of said alloy between a martensitic phase and its parent phase for selectively changing the inner radial dimension of said chamber and applying a compressive force on said parts.

2. The press recited in claim 1 further comprising a pressure transmitting medium within said chamber for transmitting isostatic pressure from said ram and from said cylinder to said parts.

3. The press recited in claim 2 wherein said medium is a pressure transmitting powder.

4. The press recited in claim 1 wherein said shape memory alloy comprises at least one alloy from the group consisting of gold-cadmium, nickel-titanium, indium-thallium, indium-cadmium, iron-nickel, nickel-aluminum, copper-zinc, copper-aluminum, iron-platinum, silver-zinc, silver-cadmium, uranium-niobium, nickel-copper-titanium and copper-aluminum-zinc.

5. The press recited in claim 1 further comprising at least one end cap having a substantially fixed inner dimension substantially equal to the inner dimension of said chamber when said alloy is in the high temperature, parent phase, said end cap being affixed to an axial end of said cylinder in contiguous engagement with said mechanical ram for sealing said chamber.

6. The press recited in claim 1 wherein said temperature controlling means comprises a hollow coiled tube or a thermally conductive jacket capable of circulating fluid in contiguous engagement with the outer periphery of said cylinder.

7. The press recited in claim 1 wherein said cylinder is a circular cylinder.

8. A isostatic pressing apparatus comprising a hollow enclosed structure at least a portion of which is formed of a shape memory alloy capable of a reversible dimensional modification when selectively transformed from a martensitic phase to its parent phase by temperature elevation for pressing a workpiece.

9. The pressing apparatus recited in claim 8 further comprising a pressure transmitting medium contained within said structure for transmitting isostatic pressure to said workpiece within said apparatus.

10. The pressing apparatus recited in claim 8 wherein said shape memory alloy comprises at least one alloy from the group consisting of gold-cadmium, nickel-titanium, indium-thallium, indium-cadmium, iron-nickel, nickel-aluminum, copper-zinc, copper-aluminum, iron-platinum, silver-zinc, silver-cadmium, uranium-niobium, nickel-copper-titanium and copper-aluminum-zinc.

* * * * *